United States Patent [19]

Knaack

[11] 4,018,182

[45] Apr. 19, 1977

[54] GOLF FLAG ASSEMBLY

[75] Inventor: Carl W. Knaack, Bloomfield Hills, Mich.

[73] Assignee: Morris Associates, Inc., Southfield, Mich.

[22] Filed: Dec. 11, 1975

[21] Appl. No.: 639,801

[52] U.S. Cl. ..... 116/173

[51] Int. Cl.[2] ..... G09F 17/00

[58] Field of Search ..... 116/173, 174, 175, 124 R

[56] References Cited

UNITED STATES PATENTS

| | | | |
|---|---|---|---|
| 3,127,869 | 4/1964 | Howland | 116/173 |
| 3,138,249 | 6/1964 | Paulini | 116/173 |

*Primary Examiner*—S. Clement Swisher
*Assistant Examiner*—Denis E. Corr
*Attorney, Agent, or Firm*—Gifford, Chandler, Sheridan & Sprinkle

[57] ABSTRACT

A golf flag assembly is provided for use in conjunction with a flagpole and comprises a flag and means for attaching the flag to the pole, said means further comprising a pair of facing panel members adapted to receive one edge of the flag therebetween and means for securing the panel members together so that the edge of the flag is entrapped between the panel members. At least one tubular cylindrical member is secured along one edge of both of the panel members so that the panel members extend radially outward from the outer periphery of the cylindrical member. The tubular cylindrical member is constructed of resilient material and is adapted to receive the flagpole therethrough so that the cylindrical member grasps the flagpole to secure the golf flag assembly to the flagpole.

1 Claim, 3 Drawing Figures

GOLF FLAG ASSEMBLY

Background of the Invention

I. Field of the Invention

The present invention relates generally to flag assembly, and more specifically, to a flag assemblies particularly suited for attaching a flag to a golf flagpole.

II. Description of the Prior Art

In the game of golf, each putting green includes a hole having a removable flagpole inserted therein. A flag is mounted at the upper extremity of the flagpole and serves to identify the position of the hole on the putting green from a distance.

In order to attach the flag to the flagpole it has been the previous practice to provide the flag with straps which are tied around the flagpole or to eyelets secured to the flagpole. It has been found, however, that the straps often become unintentionally untied so that the flags blow away and become lost. Moreover, with the flag removed from the flagpole, it is relatively difficult to see the flagpole, and hence the position of the hole on the putting green, from a distance.

Especially in this situation where the flagpole is not provided with eyelets or some other means for receiving the straps, the straps can become loosened permitting the flag to slide downwardly along the flagpole. Providing eyelets on the pole itself or some other similar means is expensive.

A still further disadvantage of the previously known golf flags, is that the relatively thin straps securing the flags to the flagpole, often times break from high wind conditions, and the like which necessitates the replacement of the entire flag.

A still further disadvantage of the previously known golf flags is that the removal and installation of the golf flag on the flagpole is a time consuming and tedious operation. This has been found to be particularly the case when the straps from the flag become overly tightened on the flagpole eyelets.

SUMMARY OF THE PRESENT INVENTION

The golf flag assembly of the present invention overcomes the aforementioned disadvantages of the previously known golf flags by providing a pair of facing panel members adapted to receive one edge of a golf flag therebetween so that when the panel members are secured together, the golf flag is securely entrapped and sandwiched between the panel members.

At least one tubular cylindrical member is secured to the panel members, and preferably integral therewith, so that one edge of both panel members is attached to the outer periphery of the cylindrical member with their edges parallel with the cylindrical member axis and the panel members extending radially outwardly from the cylindrical member. The cylindrical member is adapted to slidably fit over and resiliently grasp an ordinary flagpole and includes an upper cover which abuts against the upper end of the flagpole to position the golf flag assembly of the present invention at the upper extremity of the flagpole. Thus no modification of the flagpole is necessary to receive the golf flag of the present invention.

The golf flag assembly of the present invention is thus not only easily removed from and inserted onto the golf flagpole, but also eliminates the previously known problems associated with broken or untied straps between the golf flag and flagpole. Furthermore, the present golf flag assembly is more desirable than previously known golf flags and should last several golf seasons without the necessity of repair or replacement.

BRIEF DESCRIPTION OF THE DRAWINGS

A better understanding of the present invention will be had upon reference to the following detailed description when read in conjunction with the accompanying drawing, wherein like reference characters refer to like parts throughout the several views, and in which.

DETAILED DESCRIPTION OF THE PRESENT INVENTION

Figure 3:
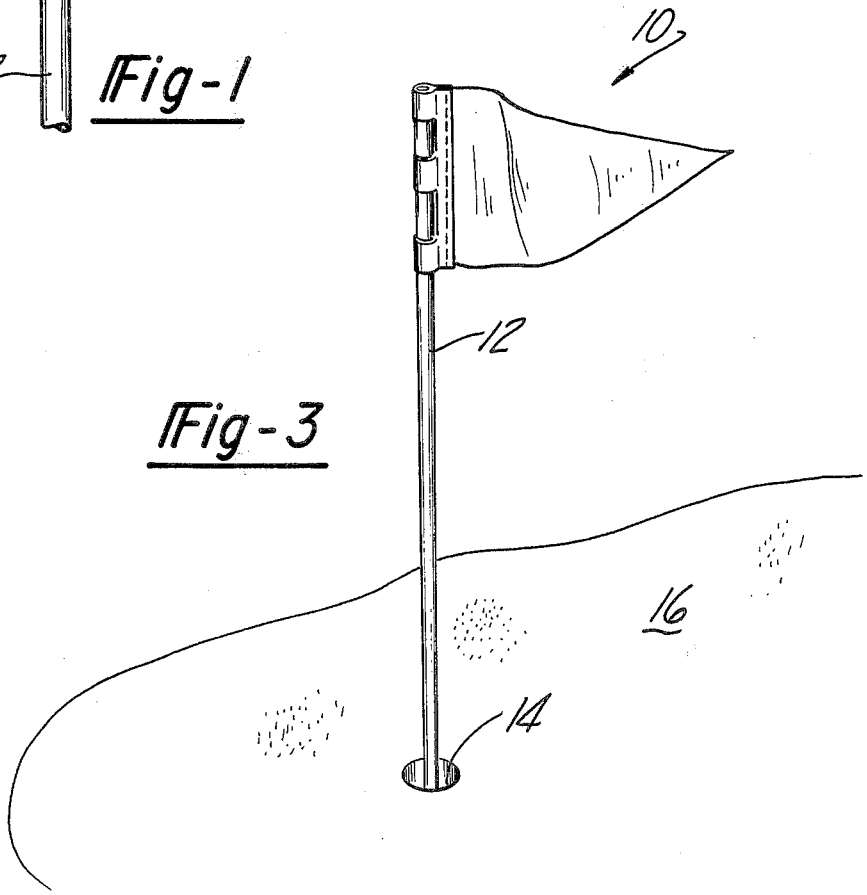
FIG. 3 is a perspective view showing the golf flag assembly of the present invention installed upon a flagpole.

Referring first to FIG. 3, the golf flag assembly 10 of the present invention is thereshown installed upon a golf flagpole 12. The golf flag assembly 10 will have suitable indicia (not shown) to indicate the number of the green 16. The flagpole 12, is inserted at its lower end into the hole 14 of the golfing green 16. The golf flag assembly 10 and the flagpole 12 thus serve to identify the particular green 16 and the exact position of the hole 14 on the green 16 from a distance.

Figure 1:
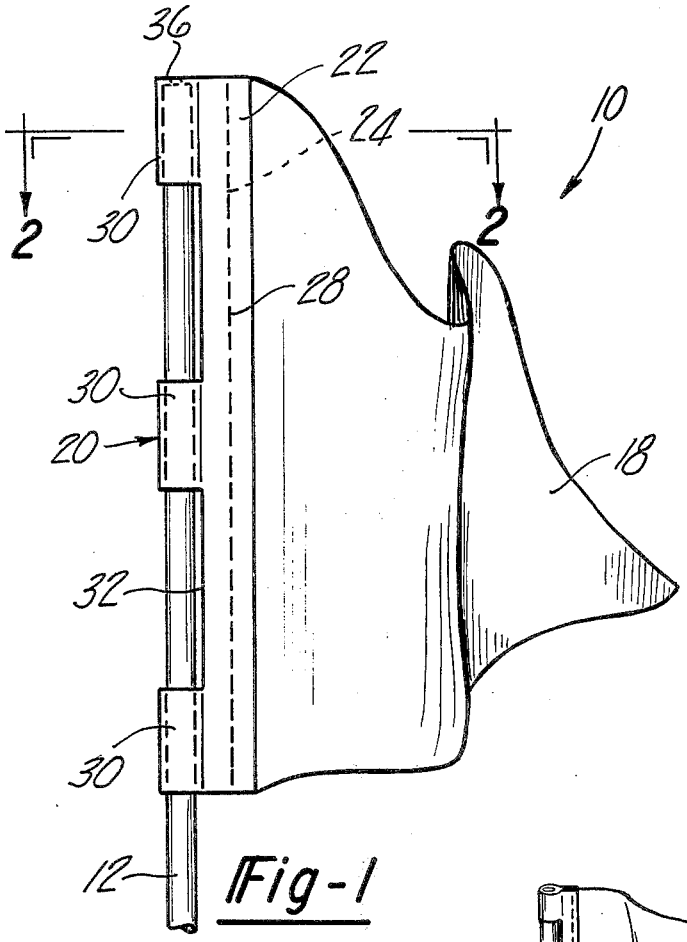
FIG. 1 is a front plan showing the golf flag assembly of the present invention.
Figure 2:
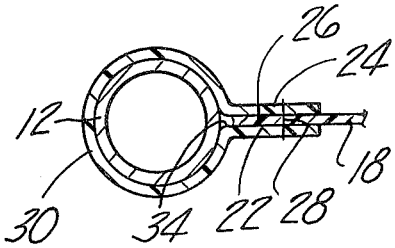
FIG. 2 is a fragmentary cross-section view taken substantially along line 2—2 of FIG. 1.

Referring now to FIGS. 1 and 2, the golf flag assembly 10 is shown as comprising a flag 18, which may be constructed of a flexible material such as cloth or plastic secured to the flagpole 12 by attachment means 20. Preferably the attachment means 20 is formed from plastic and comprises a pair of vertically elongated facing panel members 22 and 24 which are adapted to receive one edge 26 of the flag 18 therebetween. The panel members 22 and 24 are then secured together by any conventional means, such as sewing stitches 28, so that the edge 26 of the flag 18 is sandwiched between and entrapped by the panel members 22 and 24.

In order to secure the panel members 22 and 24, and hence the flag 18 to the flagpole 12, three coaxial tubular cylindrical members 30 are provided along one edge 32 of the panel members 22 and 24 and are preferably integral therewith. The edges 32 of the panel members 22 and 24 are generally parallel to the axis of the tubular members 30 and the panel members extend radially away from the outer periphery of the tubular members 30 so that the plane of the panel members 30 generally intersects the axis of the members 30. Furthermore, since the tubular members 30 and the panel members 22 and 24 are preferably integral with each other and are extruded from a relatively flat piece of material, a splice 34 is formed axially through the tubular member 30 between the panel members 22 and 24.

The tubular members 30 are constructed so that the inside diameter of the member 30 is substantially the same or slightly smaller than the outside diameter of the flagpole 12 so that as the flagpole 12 is received through the tubular members 30, illustrated in FIG. 1, the tubular members 30 resiliently grasp the flagpole 12 to secure the golf flag assembly 10 to the flagpole 12. In this manner, unintended removal of the golf flag assembly 10 from the flagpole 12 is prevented while still permitting removal of the assembly 10 from the pole 12 by pulling the assembly off from the top of the flagpole 12. Further, no means need to be provided on the flagpole 12 for receiving the golf flag assembly 10.

In addition, in order to position the flag assembly 10 on the pole 12 and to prevent the assembly 10 from gradually sliding downward on the pole 12, the upper most tubular member 30 is provided with an upper cap 36 which abuts against the upper end of the flagpole 12.

It can thus be seen that the golf flag assembly 10 of the present invention provides substantial advantages over the previously known golf flags by preventing disengagement of the golf flag from the flagpole under high wind conditions and the like. Moreover, the golf flag assembly of the present invention may be rapidly installed upon or removed from the flagpole 12 without the previously known time consuming task of untieing overly tightened knots. Nothing needs to be added to the flagpole to receive the flag and lastly, the golf flag assembly of the present invention is not only durable than the previously known golf flag assemblies but is also relatively inexpensive to manufacture and construct.

Having described my invention many modifications thereto will become apparent to those skilled in the art to which it pertains without deviation from the spirit of the invention as defined by the scope of the appended claims.

I claim:

1. In combination a golf flagpole and a golf flag assembly, said golf flagpole being of substantially uniform cross-sectional area throughout its length, said golf flag assembly comprising a flag and means for attaching said flag to said flagpole, said attaching means comprising a pair of facing panel members receiving one edge of said flag therebetween, means for securing said panel members to said edge of said flag, said attaching means further comprising a plurality of spaced cylindrical members integrally attached to said panel members, each of said cylindrical members having an inside diameter which is smaller than the outside diameter of said golf flagpole, said cylindrical members being constructed of resilient material so that each said cylindrical members resiliently grasps said flagpole, and the uppermost of said cylindrical members having an upper closed portion to maintain the flag assembly at a fixed position on the top of the flagpole.

* * * * *